US009186772B2

(12) United States Patent
Repper et al.

(10) Patent No.: US 9,186,772 B2
(45) Date of Patent: Nov. 17, 2015

(54) CHEMICAL MECHANICAL POLISHING PAD WITH BROAD SPECTRUM, ENDPOINT DETECTION WINDOW AND METHOD OF POLISHING THEREWITH

(71) Applicants: Rohm and Haas Electronic Materials CMP Holdings, Inc., Newark, DE (US); Dow Global Technologies LLC, Midland, MI (US)

(72) Inventors: Angus Repper, Lincoln Univeristy, PA (US); David B. James, Newark, DE (US); Mary A. Leugers, Midland, MI (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 358 days.

(21) Appl. No.: 13/788,485

(22) Filed: Mar. 7, 2013

(65) Prior Publication Data

US 2014/0256225 A1 Sep. 11, 2014

(51) Int. Cl.

| | |
|---|---|
| ***B24B 37/20*** | (2012.01) |
| ***B24B 37/04*** | (2012.01) |
| ***B24B 37/013*** | (2012.01) |

(52) U.S. Cl.

CPC ..... *B24B 37/205* (2013.01); *B24B 37/013* (2013.01); *B24B 37/042* (2013.01)

(58) Field of Classification Search

CPC .... B24B 7/228; B24B 37/013; B24B 37/042; B24B 37/025; B24B 49/12

See application file for complete search history.

(56) References Cited

U.S. PATENT DOCUMENTS

| | | | | |
|---|---|---|---|---|
| 5,893,796 | A | 4/1999 | Birang et al. | |
| 6,171,181 | B1 | 1/2001 | Roberts et al. | |
| 6,524,176 | B1 | 2/2003 | Cheng et al. | |
| 6,685,537 | B1 | 2/2004 | Fruitman et al. | |
| 6,716,085 | B2 | 4/2004 | Wiswesser et al. | |
| 6,832,947 | B2 * | 12/2004 | Manning | 451/41 |
| 6,832,949 | B2 | 12/2004 | Konno et al. | |
| 6,832,950 | B2 | 12/2004 | Wright et al. | |
| 6,884,156 | B2 | 4/2005 | Prasad et al. | |
| 6,984,163 | B2 | 1/2006 | Roberts | |
| 7,267,607 | B2 | 9/2007 | Prasad | |
| 7,273,407 | B2 | 9/2007 | Saikin | |
| 7,874,894 | B2 | 1/2011 | Fukuda et al. | |
| 7,927,183 | B2 | 4/2011 | Fukuda et al. | |

(Continued)

OTHER PUBLICATIONS

Natta, et al., Some Remarks on Amorphous and Atactic α-Olefin Polymers and Random Ethylene-Propylene Copolymers, Journal of Polymer Science: Part A, vol. 3, pp. 1-10 (1965).

(Continued)

*Primary Examiner* — Timothy V Eley

(74) *Attorney, Agent, or Firm* — Thomas S. Deibert

(57) ABSTRACT

A chemical mechanical polishing pad is provided, comprising: a polishing layer having a polishing surface; and, a broad spectrum, endpoint detection window block having a thickness along an axis perpendicular to a plane of the polishing surface; wherein the broad spectrum, endpoint detection window block, comprises a cyclic olefin addition polymer; wherein the broad spectrum, endpoint detection window block exhibits a uniform chemical composition across its thickness; wherein the broad spectrum, endpoint detection window block exhibits a spectrum loss ≤40%; and, wherein the polishing surface is adapted for polishing a substrate selected from a magnetic substrate, an optical substrate and a semiconductor substrate.

9 Claims, 4 Drawing Sheets

(56) References Cited

U.S. PATENT DOCUMENTS

| | | | | |
|---|---|---|---|---|
| 8,062,752 | B2 | 11/2011 | Wu | |
| 2005/0148183 | A1* | 7/2005 | Shiro et al. | 438/692 |
| 2008/0033112 | A1 | 2/2008 | Squire et al. | |
| 2008/0102734 | A1 | 5/2008 | Benvegnu et al. | |
| 2014/0256226 | A1* | 9/2014 | Repper et al. | 451/6 |
| 2014/0256231 | A1* | 9/2014 | Repper et al. | 451/41 |
| 2014/0256232 | A1* | 9/2014 | Repper et al. | 451/41 |

OTHER PUBLICATIONS

McCormic, et al., Tailored Rheology of a Metallocene Polyolefin through Silane Grafting and Subsequent Silane Crosslinking, Journal of Pjolymer Science: Part B: Polymer Physics, vol. 38, pp. 2468-2479 (2000).

Spencer, et al., Composition distribution in poly(ethylene-graft-vinyltrimethoxysilane), Polymer, 44, pp. 2015-2023 (2003).

* cited by examiner

CHEMICAL MECHANICAL POLISHING PAD WITH BROAD SPECTRUM, ENDPOINT DETECTION WINDOW AND METHOD OF POLISHING THEREWITH

The present invention relates generally to the field of chemical mechanical polishing. In particular, the present invention is directed to a chemical mechanical polishing pad with a broad spectrum, endpoint detection window block; wherein the broad spectrum, endpoint detection window block exhibits a spectrum loss ≤40%. The present invention is also directed to a method of chemical mechanical polishing of a substrate using a chemical mechanical polishing pad with a broad spectrum, endpoint detection window block; wherein the broad spectrum, endpoint detection window block exhibits a spectrum loss ≤40%.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a polishing medium (e.g., slurry) is provided between the wafer and the polishing pad. Thus, the wafer surface is polished and made planar by the chemical and mechanical action of the pad surface and the polishing medium.

One challenge presented with chemical mechanical polishing is determining when the substrate has been polished to the desired extent. In situ methods for determining polishing endpoints have been developed. The in situ optical endpointing techniques can be divided into two basic categories: (1) monitoring the reflected optical signal at a single wavelength or (2) monitoring the reflected optical signal from multiple wavelengths. Typical wavelengths used for optical endpointing include those in the visible spectrum (e.g., 400 to 700 nm), the ultraviolet spectrum (315 to 400 nm), and the infrared spectrum (e.g., 700 to 1000 nm). In U.S. Pat. No. 5,433,651, Lustig et al disclosed a polymeric endpoint detection method using a single wavelength in which light from a laser source is transmitted on a wafer surface and the reflected signal is monitored. As the composition at the wafer surface changes from one metal to another, the reflectivity changes. This change in reflectivity is then used to detect the polishing endpoint. In U.S. Pat. No. 6,106,662, Bibby et al disclosed using a spectrometer to acquire an intensity spectrum of reflected light in the visible range of the optical spectrum. In metal CMP applications, Bibby et al. teach using the whole spectrum to detect the polishing endpoint.

To accommodate these optical endpointing techniques, chemical mechanical polishing pads have been developed having windows. For example, in U.S. Pat. No. 5,605,760, Roberts discloses a polishing pad wherein at least a portion of the pad is transparent to laser light over a range of wavelengths. In some of the disclosed embodiments, Roberts teaches a polishing pad that includes a transparent window piece in an otherwise opaque pad. The window piece may be a rod or plug of transparent polymer in a molded polishing pad. The rod or plug may be insert molded within the polishing pad (i.e., an "integral window"), or may be installed into a cut out in the polishing pad after the molding operation (i.e., a "plug in place window").

Aliphatic isocyanate based polyurethane materials, such as those described in U.S. Pat. No. 6,984,163 provided improved light transmission over a broad light spectrum. Unfortunately, these aliphatic polyurethane windows tend to lack the requisite durability required for demanding polishing applications.

Conventional polymer based endpoint detection windows often exhibit undesirable degradation upon exposure to light having a wavelength of 330 to 425 nm. This is particularly true for polymeric endpoint detection windows derived from aromatic polyamines, which tend to decompose or yellow upon exposure to light in the ultraviolet spectrum. Historically, filters have sometimes been used in the path of the light used for endpoint detection purposes to attenuate light having such wavelengths before exposure to the endpoint detection window. Increasingly, however, there is pressure to utilize light with shorter wavelengths for endpoint detection purposes in semiconductor polishing applications to facilitate thinner material layers and smaller device sizes.

Accordingly, what is needed is a broad spectrum, endpoint detection window block that enables the use of light having a wavelength <400 nm for substrate polishing endpoint detection purposes, wherein the broad spectrum, endpoint detection window block is resistant to degradation upon exposure to that light and exhibits the required durability for demanding polishing applications.

The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer; wherein the broad spectrum, endpoint detection window block exhibits a uniform chemical composition across its thickness, $T_W$; wherein the broad spectrum, endpoint detection window block exhibits a spectrum loss ≤40%; and, wherein the polishing surface is adapted for polishing a substrate selected from a magnetic substrate, an optical substrate and a semiconductor substrate.

The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer; wherein the broad spectrum, endpoint detection window block exhibits a uniform chemical composition across its thickness, $T_W$; wherein the broad spectrum, endpoint detection window block exhibits a spectrum loss ≤40%; wherein the broad spectrum, endpoint detection window block is ≥90 wt % cyclic olefin addition polymer, wherein the broad spectrum, endpoint detection window block comprises <1 ppm halogen; wherein the broad spectrum, endpoint detection window block comprises <1 liquid filled polymeric capsule; wherein the endpoint detection window block has an average thickness, $T_{W\text{-}avg}$, along an axis perpendicular to the plane of the polishing surface of 5 to 75 mils; and, wherein the polishing surface is adapted for polishing a substrate selected from a magnetic substrate, an optical substrate and a semiconductor substrate The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer, wherein the cyclic olefin addition polymer is selected from a cyclic olefin addition polymer and a cyclic olefin addition copolymer; wherein the broad spectrum, endpoint detection window block exhibits a uniform chemical composition across its thickness, $T_W$; wherein the broad spectrum, endpoint detection window block exhibits a spectrum loss ≤40%; wherein the broad spectrum, endpoint detection window block is ≥90 wt % cyclic olefin addition polymer, wherein the broad spectrum, endpoint detection window block comprises <1 ppm halogen; wherein the broad spectrum, endpoint detection window block comprises <1 liquid filled polymeric capsule; wherein the endpoint detection window block has an average thickness, $T_{W\text{-}avg}$, along an axis perpendicular to the plane of the polishing surface of 5 to 75 mils; and, wherein the polishing surface is adapted for polishing a substrate selected from a magnetic substrate, an optical substrate and a semiconductor substrate.

The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer, wherein the cyclic olefin addition polymer is a cyclic olefin addition polymer, wherein the cyclic olefin addition polymer is produced from a polymerization of at least one alicyclic monomer, wherein the at least one alicyclic monomer is selected from the group consisting of alicyclic monomers having an endocyclic double bond and alicyclic monomers having an exocyclic double bond; wherein the broad spectrum, endpoint detection window block exhibits a uniform chemical composition across its thickness, $T_W$; wherein the broad spectrum, endpoint detection window block exhibits a spectrum loss ≤40%; wherein the broad spectrum, endpoint detection window block is ≥90 wt % cyclic olefin addition polymer, wherein the broad spectrum, endpoint detection window block comprises <1 ppm halogen; wherein the broad spectrum, endpoint detection window block comprises <1 liquid filled polymeric capsule; wherein the endpoint detection window block has an average thickness, $T_{W\text{-}avg}$, along an axis perpendicular to the plane of the polishing surface of 5 to 75 mils; and, wherein the polishing surface is adapted for polishing a substrate selected from a magnetic substrate, an optical substrate and a semiconductor substrate.

The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer, wherein the cyclic olefin addition polymer is a cyclic olefin addition copolymer; wherein the cyclic olefin addition copolymer is produced from a copolymerization of at least one alicyclic monomer and at least one acyclic olefin monomer; wherein the broad spectrum, endpoint detection window block exhibits a uniform chemical composition across its thickness, $T_W$; wherein the broad spectrum, endpoint detection window block exhibits a spectrum loss ≤40%; wherein the broad spectrum, endpoint detection window block is ≥90 wt % cyclic olefin addition polymer, wherein the broad spectrum, endpoint detection window block comprises <1 ppm halogen; wherein the broad spectrum, endpoint detection window block comprises <1 liquid filled polymeric capsule; wherein the endpoint detection window block has an average thickness, $T_{W\text{-}avg}$, along an axis perpendicular to the plane of the polishing surface of 5 to 75 mils; and, wherein the polishing surface is adapted for polishing a substrate selected from a magnetic substrate, an optical substrate and a semiconductor substrate.

The present invention provides a chemical mechanical polishing pad comprising: a polishing layer having a polishing surface; and, a broad spectrum, endpoint detection window block having a thickness, $T_W$, along an axis perpendicular to a plane of the polishing surface; wherein the broad spectrum, endpoint detection window block, comprises a cyclic olefin addition polymer; wherein the cyclic olefin addition polymer is represented by a formula selected from the group consisting of (I)

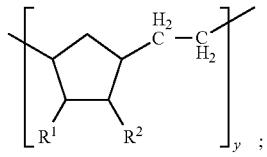

wherein y is 20 to 20,000; and, wherein $R^1$ and $R^2$ are each independently selected from the group consisting of a H, a hydroxyl group, a $C_{1\text{-}10}$-alkyl group, a $C_{1\text{-}10}$-hydroxyalkyl group, a $C_{1\text{-}10}$ alkoxyl group, a $C_{1\text{-}10}$ alkoxyalkyl group, a $C_{1\text{-}10}$ carboxyalkyl group, a $C_{1\text{-}10}$ alkoxycarbonyl and a $C_{1\text{-}10}$-alkylcarbonyl;

(II)

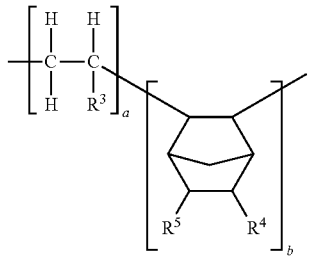

wherein the ratio of a:b is 0.5:99.5 to 30:70; wherein $R^3$ is selected from the group selected from a H and a $C_{1\text{-}10}$ alkyl group; and, wherein $R^4$ and $R^5$ are each independently selected from the group consisting of a H, a hydroxyl group, a $C_{1\text{-}10}$ alkyl group, a $C_{1\text{-}10}$ hydroxyalkyl group, a $C_{1\text{-}10}$ alkoxyl group, a $C_{1\text{-}10}$ alkoxyalkyl group, a $C_{1\text{-}10}$ carboxyalkyl group, a $C_{1\text{-}10}$ alkoxycarbonyl and a $C_{1\text{-}10}$ alkylcarbonyl;

(III)

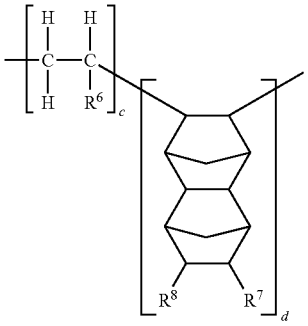

wherein the ratio of c:d in the cyclic olefin addition copolymer is 0.5:99.5 to 50:50; wherein $R^6$ is selected from the group selected from H and a $C_{1-10}$ alkyl group; and, wherein $R^7$ and $R^8$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl; and, (IV)

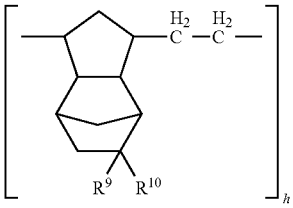

wherein h is 20 to 20,000; and, wherein $R^9$ and $R^{10}$ are each independently selected from the group consisting of a H, a hydroxyl group, a $C_{1-10}$-alkyl group, a $C_{1-10}$-hydroxyalkyl group, a $C_{1-10}$ alkoxyl group, a $C_{1-10}$ alkoxyalkyl group, a $C_{1-10}$ carboxyalkyl group, a $C_{1-10}$-alkoxycarbonyl and a $C_{1-10}$ alkylcarbonyl; wherein the broad spectrum, endpoint detection window block exhibits a uniform chemical composition across its thickness, $T_W$; wherein the broad spectrum, endpoint detection window block exhibits a spectrum loss ≤40%; wherein the broad spectrum, endpoint detection window block is ≥90 wt % cyclic olefin addition polymer, wherein the broad spectrum, endpoint detection window block comprises <1 ppm halogen; wherein the broad spectrum, endpoint detection window block comprises <1 liquid filled polymeric capsule; wherein the endpoint detection window block has an average thickness, $T_{W\text{-}avg}$, along an axis perpendicular to the plane of the polishing surface of 5 to 75 mils; and, wherein the polishing surface is adapted for polishing a substrate selected from a magnetic substrate, an optical substrate and a semiconductor substrate.

The present invention provides a method of chemical mechanical polishing of a substrate comprising: providing a chemical mechanical polishing apparatus having a platen, a light source and a photosensor; providing at least one substrate selected from a magnetic substrate, an optical substrate and a semiconductor substrate; providing a chemical mechanical polishing pad of the present invention; installing onto the platen the chemical mechanical polishing pad; optionally providing a polishing medium at an interface between the polishing surface and the substrate; creating dynamic contact between the polishing surface and the substrate, wherein at least some material is removed from the substrate; and, determining a polishing endpoint by transmitting light from the light source through the broad spectrum, endpoint detection window block and analyzing the light reflected off the surface of the substrate back through the broad spectrum, endpoint detection window block incident upon the photosensor.

DETAILED DESCRIPTION

Figure 1:
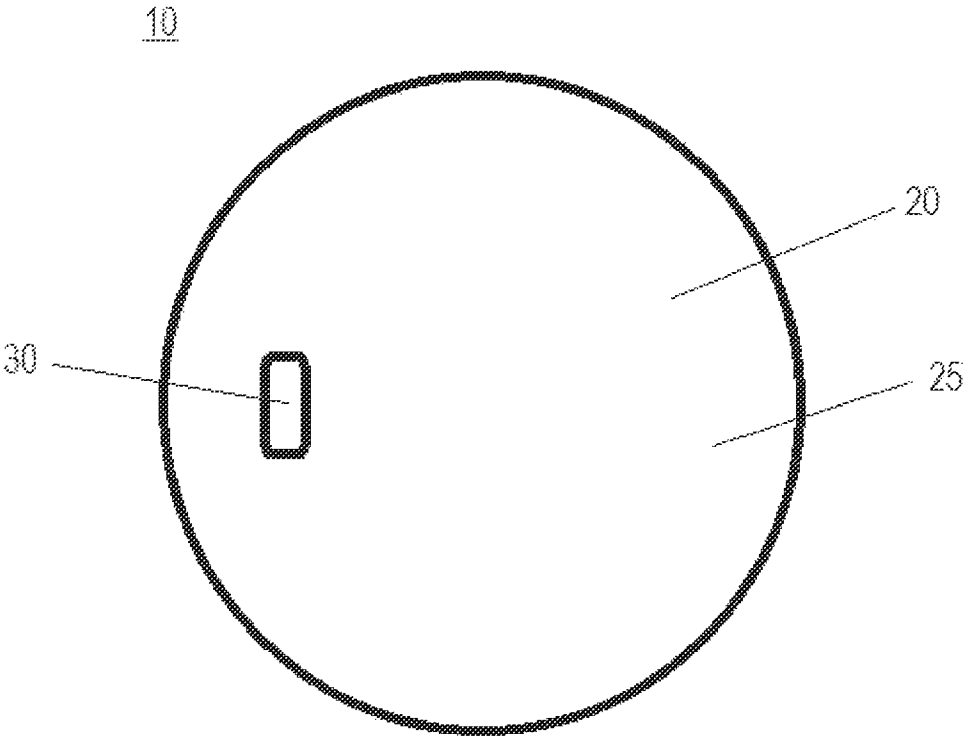
FIG. 1 is a top plan view of a preferred chemical mechanical polishing pad of the present invention.

The chemical mechanical polishing pad of the present invention is useful for polishing a substrate selected from a magnetic substrate, an optical substrate and a semiconductor substrate. In particular, the chemical mechanical polishing pad of the present invention is useful for polishing semiconductor wafers-especially for advanced applications utilize broad spectrum (i.e., multiwavelength) endpoint detection.

The term "polishing medium" as used herein and in the appended claims encompasses particle containing polishing solutions and nonparticle containing polishing solutions, such as abrasive free and reactive liquid polishing solutions.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines (including diamines and polyamines) or a combination of water and amines (including diamines and polyamines).

The term "halogen free" as used herein and in the appended claims in reference to a broad spectrum, endpoint detection window block means that the broad spectrum, endpoint detection window block contains <100 ppm halogen concentration.

The term "liquid free" as used herein and in the appended claims in reference to a broad, spectrum, endpoint detection window block means that the broad spectrum, endpoint detection window block contains <0.001 wt % material in a liquid state under atmospheric conditions.

The term "liquid filled polymeric capsule" as used herein and in the appended claims refers to a material comprising a polymeric shell surrounding a liquid core.

The term "liquid filled polymeric capsule free" as used herein and in the appended claims in reference to a broad, spectrum, endpoint detection window block means that the broad spectrum, endpoint detection window block contains <1 liquid filled polymeric capsule.

The term "spectrum loss" as used herein and in the appended claims in reference to a given material is determined using the following equation $$SL=|(TL_{300}+TL_{800})/2|$$

wherein SL is the absolute value of the spectrum loss (in %); $TL_{300}$ is the transmission loss at 300 nm; and $TL_{800}$ is the transmission loss at 800 nm.

The term "transmission loss at λ" or "$TL_\lambda$" as used herein and in the appended claims in reference to a given material is determined using the following equation $$TL_\lambda=100*((PATL_\lambda-ITL_\lambda)/ITL_\lambda)$$

wherein λ is the wavelength of light; $TL_\lambda$ is the transmission loss at λ (in %); $PATL_\lambda$ is the transmission of light with a wavelength λ through a sample of the given material measured using a spectrometer following the abrasion of the sample under the conditions described herein in the Examples according to ASTM D1044-08; and, $ITL_\lambda$ is the transmission of light at a wavelength λ through the sample measured using a spectrometer before abrasion of the sample according to ASTM D1044-08.

The term "transmission loss at 300 nm" or "$TL_{300}$" as used herein and in the appended claims in reference to a given material is determined using the following equation $$TL_{300}=100*((PATL_{300}-ITL_{300})/ITL_{300})$$

wherein $TL_{300}$ is the transmission loss at 300 nm (in %); $PATL_{300}$ is the transmission of light at a wavelength of 300 nm through a sample of the given material measured using a spectrometer following the abrasion of the sample under the conditions described herein in the Examples according to ASTM D1044-08; and, $ITL_{300}$ is the transmission of light at a wavelength of 300 nm through the sample measured using a spectrometer before abrasion of the sample according to ASTM D1044-08.

The term "transmission loss at 800 nm" or "$TL_{800}$" as used herein and in the appended claims in reference to a given material is determined using the following equation $$TL_{800}=100*((PATL_{800}-ITL_{800})/ITL_{800})$$

wherein $TL_{800}$ is the transmission loss at 800 nm (in %); $PATL_{800}$ is the transmission of light at a wavelength of 800 nm through a sample of the given material measured using a spectrometer following the abrasion of the sample under the conditions described herein in the Examples according to ASTM D1044-08; and, $ITL_{800}$ is the transmission of light at a wavelength of 800 nm through the sample measured using a spectrometer before abrasion of the sample according to ASTM D1044-08.

Figure 2:
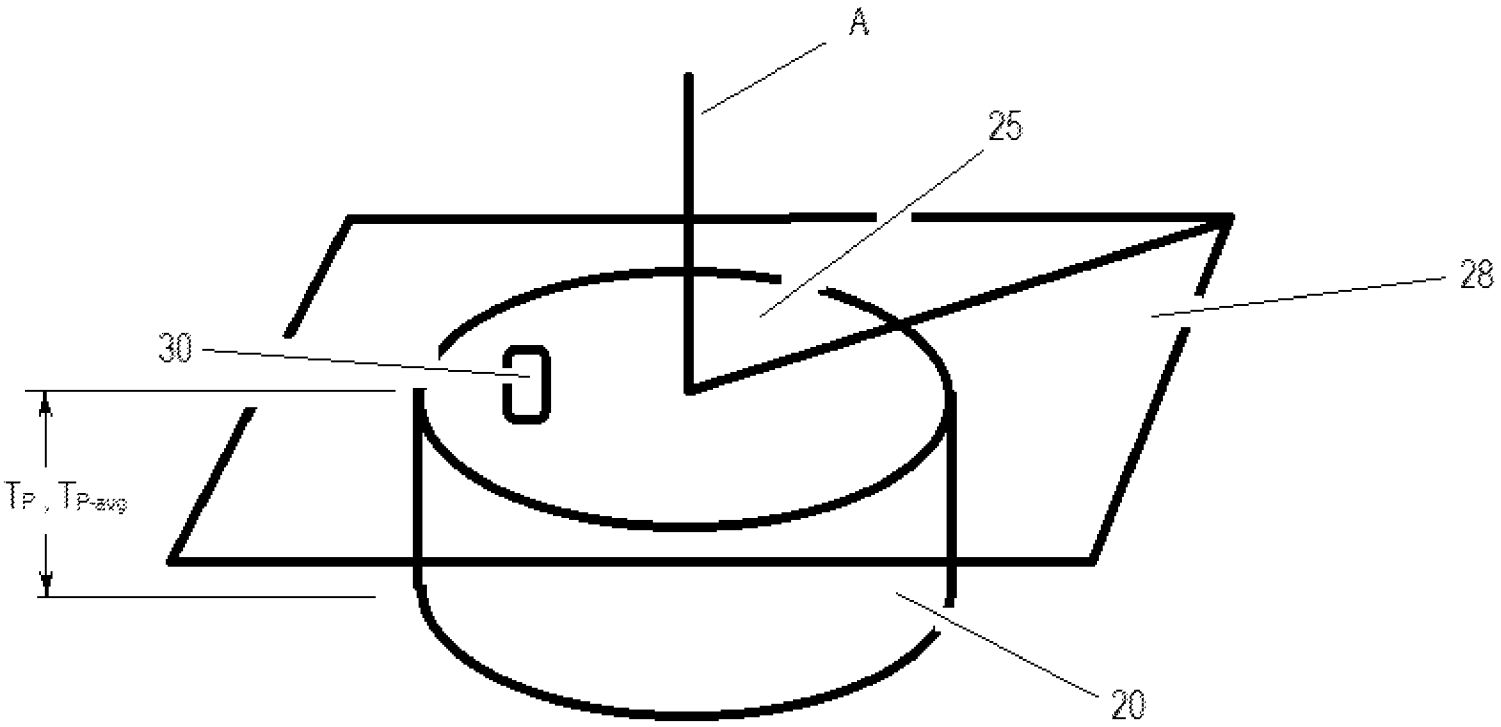
FIG. 2 is a side perspective view of a preferred chemical mechanical polishing layer of the present invention.
Figure 3:
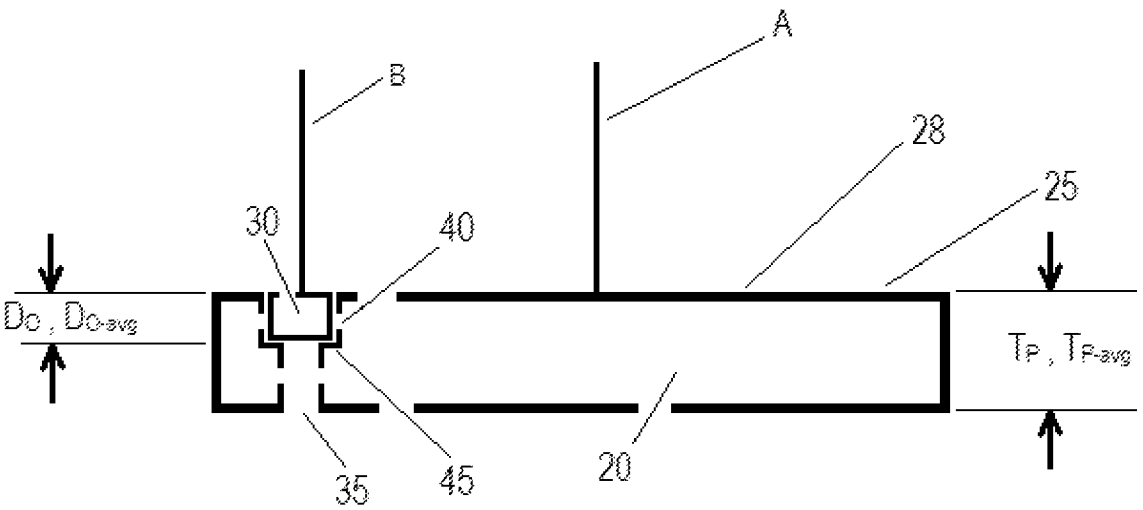
FIG. 3 is a side elevational view of a cross section of a preferred chemical mechanical polishing layer of the present invention.

The chemical mechanical polishing pad (10) of the present invention, comprises: a polishing layer (20) having a polishing surface (25); and, a broad spectrum, endpoint detection window block (30) having a thickness, $T_W$, along an axis (B) perpendicular to a plane (28) of the polishing surface (25); wherein the broad spectrum, endpoint detection window block (30), comprises a cyclic olefin addition polymer; wherein the broad spectrum, endpoint detection window block (30) exhibits a uniform chemical composition across its thickness, $T_W$; wherein the broad spectrum, endpoint detection window block (30) exhibits a spectrum loss ≤40%; and, wherein the polishing surface (25) is adapted for polishing a substrate selected from a magnetic substrate, an optical substrate and a semiconductor substrate. (See FIGS. 1-3).

The polishing layer in the chemical mechanical polishing pad of the present invention is preferably a polymeric material comprising a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, EPDM, and combinations thereof. Most preferably, the polishing layer comprises a polyurethane. One of ordinary skill in the art will understands to select a polishing layer having a thickness, $T_P$, suitable for use in a chemical mechanical polishing pad for a given polishing operation. Preferably, the polishing layer exhibits an average thickness, $T_{P\text{-}avg}$, along an axis (A) perpendicular to a plane (28) of the polishing surface (25). (See FIG. 3). More preferably, the average thickness, $T_{P\text{-}avg}$, is 20 to 150 mils (more preferably 30 to 125 mils; most preferably 40 to 120 mils).

The broad spectrum, endpoint detection window block used in the chemical mechanical polishing pad of the present invention, comprises a cyclic olefin addition polymer. Preferably, the broad spectrum, endpoint detection window block is ≥90 wt % cyclic olefin addition polymer (more preferably, ≥95 wt % cyclic olefin addition polymer; most preferably ≥98 wt % cyclic olefin addition polymer). Preferably, the broad spectrum, endpoint detection window block is halogen free. More preferably, the broad spectrum, endpoint detection window block comprises <1 ppm halogen. Most preferably, the broad spectrum, endpoint detection window block comprises <0.5 ppm halogen. Preferably, the broad spectrum, endpoint detection window block is liquid free. Preferably, the broad spectrum, endpoint detection window block is liquid filled polymeric capsule free.

The cyclic olefin addition polymer is preferably selected from cyclic olefin addition polymers and cyclic olefin addition copolymers.

The cyclic olefin addition polymer is preferably produced from the polymerization of at least one alicyclic monomer. Preferred alicyclic monomers are selected from alicyclic monomers having an endocyclic double bond and alicyclic monomers having an exocyclic double bond. Preferred alicyclic monomers having an endocyclic double bond are selected from the group consisting of norbornene; tricyclodecene; dicyclopentadiene; tetracyclododecene; hexacycloheptadecene; tricycloundecene; pentacyclohexadecene; ethylidene norbornene; vinyl norbornene; norbornadiene; alkylnorbornenes; cyclopentene; cyclopropene; cyclobutene; cyclohexene; cyclopentadiene; cyclohexadiene; cyclooctatriene; and, indene. Preferred alicyclic monomers having an exocyclic double bond include, for example, alkyl derivatives of cyclic olefins (e.g., vinyl cyclohexene, vinyl cyclohexane, vinyl cyclopentane, vinyl cyclopentene).

The cyclic olefin addition copolymer is preferably produced from the copolymerization of at least one alicyclic monomer (as described above) and at least one acyclic olefin monomer. Preferred acyclic olefin monomers are selected from the group consisting of 1-alkenes (e.g., ethylene; propylene; 1-butene; isobutene; 2-butene; 1-pentene; 1-hexene; 1-heptene; 1-octene; 1-nonene; 1-decene; 2-methyl-1-propene; 3-methyl-1-pentene; 4-methyl-1-pentene); and, 2-butene. The acyclic olefin monomer optionally includes dienes. Preferred dienes are selected from the group consisting of butadiene; isoprene; 1,3-pentadiene; 1,4-pentadiene; 1,3-hexadiene; 1,4-hexadiene; 1,5-hexadiene; 1,5-heptadiene; 1,6-heptadiene; 1,6-octadiene; 1,7-octadiene; and, 1,9-decadiene.

The cyclic olefin addition copolymers are preferably selected from the group consisting of ethylene-norbornene copolymers; ethylene-dicyclopentadiene copolymers; ethylene-cyclopentene copolymers; ethylene-indene copolymers; ethylene-tetracyclododecene copolymers; propylene-norbornene copolymers; propylene-dicyclopentadiene copolymers; ethylene-norbornene-dicyclopentadiene terpolymers; ethylene-norbornene-ethylidene norbornene terpolymers; ethylene-norbornene-vinylnorbornene terpolymers; ethylene-norbornene-1,7-octadiene terpolymers; ethylenenorbornene-vinylcyclohexene terpolymers; and, ethylenenorbornene-7-methyl-1,6-octadiene terpolymers.

The cyclic olefin addition polymer is preferably represented by a formula selected from the group consisting of (I)

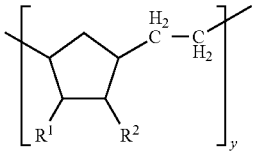

wherein y is the weight average number of repeating units per molecule and is 20 to 20,000 (preferably, 50 to 15,000; more preferably, 75 to 10,000; most preferably 200 to 5,000); and, wherein $R^1$ and $R^2$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl (preferably, wherein $R^1$ and $R^2$ are each independently selected from the group selected from the group consisting of a H, a hydroxyl group, a $C_{1-4}$ alkyl group, a $C_{1-4}$ hydroxyalkyl group, a $C_{1-4}$ alkoxyl group, a $C_{1-4}$ alkoxyalkyl group, a $C_{1-4}$ carboxyalkyl group, a $C_{1-4}$ alkoxycarbonyl and a $C_{1-4}$ alkylcarbonyl; more preferably, wherein $R^1$ and $R^2$ are each independently selected from the group selected from the group consisting of a H, a methyl group, a $C_{1-3}$ hydroxyalkyl group, a $C_{1-3}$alkoxyl group, a $C_{1-3}$alkoxyalkyl group, a $C_{1-3}$-carboxyalkyl group, a $C_{1-3}$alkoxycarbonyl and a $C_{1-3}$alkylcarbonyl; most preferably, wherein $R^1$ and $R^2$ are each independently selected from the group consisting of a H, a methyl group and —C(O)$OCH_2$);

(II)

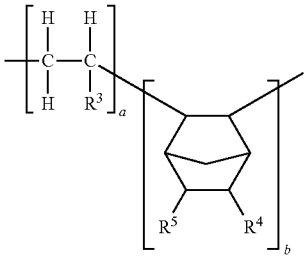

wherein the ratio of a:b is 0.5:99.5 to 30:70; wherein $R^3$ is selected from the group selected from a H and a $C_{1-10}$ alkyl group (preferably, a H and a $C_{1-4}$ alkyl group; more preferably, a H and a methyl group; most preferably, a H); and, wherein $R^4$ and $R^5$ are each independently selected from the group consisting of a H, a hydroxyl group, a $C_{1-10}$-alkyl group, a $C_{1-10}$ hydroxyalkyl group, a $C_{1-10}$-alkoxyl group, a $C_{1-10}$-alkoxyalkyl group, a $C_{1-10}$-carboxyalkyl group, a $C_{1-10}$ alkoxycarbonyl and a $C_{1-10}$ alkylcarbonyl (preferably, wherein $R^4$ and $R^5$ are each independently selected from the group selected from the group consisting of a H, a hydroxyl group, a $C_{1-4}$ alkyl group, a $C_{1-4}$ hydroxyalkyl group, a $C_{1-4}$ alkoxyl group, a $C_{1-4}$ alkoxyalkyl group, a $C_{1-4}$ carboxyalkyl group, a $C_{1-4}$ alkoxycarbonyl and a $C_{1-4}$ alkylcarbonyl; more preferably, wherein $R^4$ and $R^5$ are each independently selected from the group selected from the group consisting of a H, a methyl group, a $C_{1-3}$ hydroxyalkyl group, a $C_{1-3}$alkoxyl group, a $C_{1-3}$ alkoxyalkyl group, a $C_{1-3}$ carboxyalkyl group, a $C_{1-3}$ alkoxycarbonyl and a $C_{1-3}$ alkylcarbonyl; most preferably, wherein $R^4$ and $R^5$ are each independently selected from the group consisting of a H, a methyl group and —C(O)$OCH_2$);

(III)

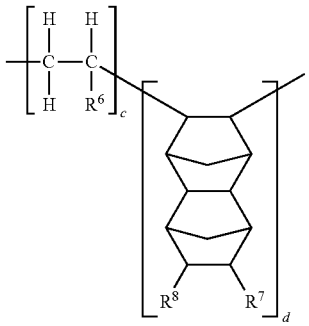

wherein the ratio of c:d in the cyclic olefin addition copolymer is 0.5:99.5 to 50:50 (preferably, 0.5:99.5 to 20:80); wherein $R^6$ is selected from the group selected from H and a $C_{1-10}$ alkyl group (preferably, H and a $C_{1-4}$ alkyl group; more preferably, H and a methyl group; most preferably, H); and, wherein $R^7$ and $R^8$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl (preferably, wherein $R^7$ and $R^8$ are each independently selected from the group selected from the group consisting of a H, a hydroxyl group, a $C_{1-4}$ alkyl group, a $C_{1-4}$ hydroxyalkyl group, a $C_{1-4}$ alkoxyl group, a $C_{1-4}$ alkoxyalkyl group, a $C_{1-4}$ carboxyalkyl group, a $C_{1-4}$ alkoxycarbonyl and a $C_{1-4}$alkylcarbonyl; more preferably, wherein $R^7$ and $R^8$ are each independently selected from the group selected from the group consisting of a H, a methyl group, a $C_{1-3}$ hydroxyalkyl group, a $C_{1-3}$ alkoxyl group, a $C_{1-3}$alkoxyalkyl group, a $C_{1-3}$ carboxyalkyl group, a $C_{1-3}$ alkoxycarbonyl and a $C_{1-3}$ alkylcarbonyl; most preferably, wherein $R^7$ and $R^8$ are each independently selected from the group consisting of a H, a methyl group and —C(O)$OCH_2$); and, (IV)

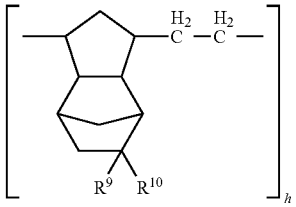

wherein h is 20 to 20,000 (preferably, 50 to 15,000; more preferably, 75 to 10,000; most preferably 200 to 5,000); and, wherein $R^9$ and $R^{10}$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl (preferably, wherein $R^9$ and $R^{10}$ are each independently selected from the group selected from the group consisting of a H, a hydroxyl group, a $C_{1-4}$ alkyl group, a $C_{1-4}$ hydroxyalkyl group, a $C_{1-4}$ alkoxyl group, a $C_{1-4}$ alkoxyalkyl group, a $C_{1-4}$ carboxyalkyl group, a $C_{1-4}$ alkoxycarbonyl and a $C_{1-4}$ alkylcarbonyl; more preferably, wherein $R^9$ and $R^{10}$ are each independently selected from the group selected from the group consisting of a H, a methyl group, a $C_{1-3}$ hydroxyalkyl group, a $C_{1-3}$ alkoxyl group, a $C_{1-3}$ alkoxyalkyl group, a $C_{1-3}$ carboxyalkyl group, a $C_{1-3}$ alkoxycarbonyl and a $C_{1-3}$ alkylcarbonyl; most preferably, wherein $R^9$ and $R^{10}$ are each independently selected from the group consisting of a H, a methyl group and —C(O)$OCH_2$).

The cyclic olefin addition polymer preferably exhibits a glass transition temperature of 100 to 200° C. (more preferably, 130 to 150° C.) as determined using conventional differential scanning calorimetry.

The cyclic olefin addition polymer preferably exhibits a number average molecular weight, $M_n$, of 1,000 to 1,000,000 g/mol (more preferably, 5,000 to 500,000 g/mol; most preferably, 10,000 to 300,000 g/mol).

Figure 4:
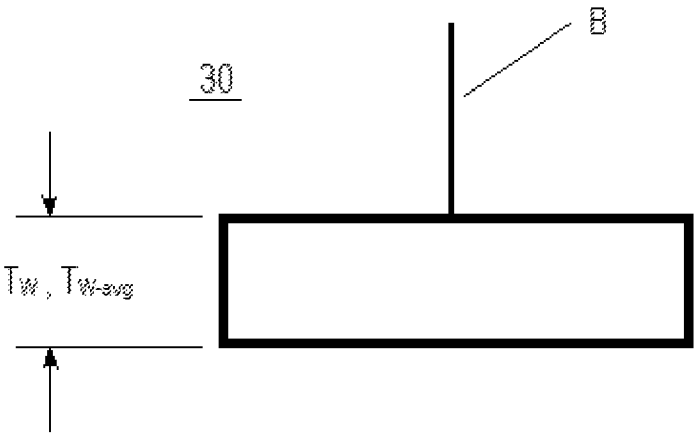
FIG. 4 is a side elevational view of a broad spectrum, endpoint detection window block.

The broad spectrum, endpoint detection window block used in the chemical mechanical polishing pad of the present invention, has a thickness, $T_W$, along an axis perpendicular to a plane of the polishing surface. Preferably, the broad spectrum, endpoint detection window block has an average thickness, $T_{W\text{-}avg}$, along an axis, B, perpendicular to the plane (28) of the polishing surface (25) when incorporated into a polishing layer (20). (See FIGS. 3-4). More preferably, the average thickness, $T_{W\text{-}avg}$, is 5 to 75 mils (still more preferably 10 to 60 mils; yet still more preferably 15 to 50 mils; most preferably, 20 to 40 mils).

The chemical mechanical polishing pad of the present invention is preferably adapted to be interfaced with a platen of a polishing machine. The chemical mechanical polishing pad of the present invention is optionally adapted to be affixed to the platen using at least one of a pressure sensitive adhesive and vacuum.

The polishing surface of the polishing layer of the chemical mechanical polishing pad of the present invention optionally exhibits at least one of macrotexture and microtexture to facilitate polishing the substrate. Preferably, the polishing surface exhibits macrotexture, wherein the macrotexture is designed to do at least one of (i) alleviate at least one of hydroplaning; (ii) influence polishing medium flow; (iii) modify the stiffness of the polishing layer; (iv) reduce edge effects; and, (v) facilitate the transfer of polishing debris away from the area between the polishing surface and the substrate.

The polishing surface of the polishing layer of the chemical mechanical polishing pad of the present invention optionally exhibits macrotexture selected from at least one of perforations and grooves. Preferably, the perforations can extend from the polishing surface part way or all of the way through the thickness, $T_P$, of the polishing layer (20). Preferably, the grooves are arranged on the polishing surface such that upon rotation of the pad during polishing, at least one groove sweeps over the substrate. Preferably, the grooves are selected from curved grooves, linear grooves and combinations thereof. The grooves exhibit a depth of ≥10 mils; preferably 10 to 150 mils. Preferably, the grooves form a groove pattern that comprises at least two grooves having a combination of a depth selected from ≥10 mils, ≥15 mils and 15 to 150 mils; a width selected from ≥10 mils and 10 to 100 mils; and a pitch selected from ≥30 mils, ≥50 mils, 50 to 200 mils, 70 to 200 mils, and 90 to 200 mils.

The broad spectrum, endpoint detection window block (30) used in the chemical mechanical polishing pad (10) of the present invention is a plug-in-place window. Preferably, the polishing layer (20) has a counterbore opening (40) that enlarges a through passage (35) that extends through the thickness, $T_P$, of the polishing layer (20), wherein the counterbore opening (40) opens on the polishing surface and forms a ledge (45) at an interface between the counterbore opening (40) and the through passage (35) at a depth, $D_O$, along an axis, B, parallel with an axis, A, and perpendicular to the plane (28) of the polishing surface (25). (See FIG. 3). Preferably, the ledge (45) is parallel with the polishing surface (25). Preferably, the ledge (45) is parallel with the polishing surface (25). Preferably, the counterbore opening defines a cylindrical volume with an axis that is parallel to axis (A). Preferably, the counterbore opening defines a non-cylindrical volume. Preferably, the broad spectrum, endpoint detection window block (30) is disposed within the counterbore opening (40). Preferably, the broad spectrum, endpoint detection window block (30) is disposed within the counterbore opening (40) and adhered to the polishing layer (20). Preferably, the broad spectrum, endpoint detection window block (30) is adhered to the polishing layer (20) using at least one of ultrasonic welding and an adhesive. Preferably, the average depth of the counterbore opening, $D_{O\text{-}avg}$, along an axis, B, parallel with an axis, A, and perpendicular to the plane (28) of the polishing surface (25) is 5 to 75 mils (preferably 10 to 60 mils; more preferably 15 to 50 mils; most preferably, 20 to 40 mils). Preferably, the average depth of the counterbore opening, $D_{O\text{-}avg}$, is ≤the average thickness, $T_{W\text{-}avg}$, of the broad spectrum, endpoint detection window block (30). More preferably, the average depth of the counterbore opening, $D_{O\text{-}avg}$, satisfies the following expression $$0.90*T_{W\text{-}avg} \leq D_{O\text{-}avg} \leq T_{W\text{-}avg}.$$

More preferably, the average depth of the counterbore opening, $D_{O\text{-}avg}$, satisfies the following expression $$0.95*T_{W\text{-}avg} \leq D_{O\text{-}avg} < T_{W\text{-}avg}.$$

The chemical mechanical polishing pad of the present invention optionally further comprises a base layer interfaced with the polishing layer. The polishing layer can optionally be attached to the base layer using an adhesive. The adhesive can be selected from pressure sensitive adhesives, hot melt adhesives, contact adhesives and combinations thereof. Preferably, the adhesive is a hot melt adhesive or a pressure sensitive adhesive. More preferably, the adhesive is a hot melt adhesive.

The chemical mechanical polishing pad of the present invention optionally further comprises a base layer and at least one additional layer interfaced with and interposed between the polishing layer and the base layer. The various layers can optionally be attached together using an adhesive. The adhesive can be selected from pressure sensitive adhesives, hot melt adhesives, contact adhesives and combinations thereof. Preferably, the adhesive is a hot melt adhesive or a pressure sensitive adhesive. More preferably, the adhesive is a hot melt adhesive.

The method of the present invention for chemical mechanical polishing of a substrate comprises: providing a chemical mechanical polishing apparatus having a platen, a light source and a photosensor (preferably a multisensor spectrograph); providing at least one substrate selected from a magnetic substrate, an optical substrate and a semiconductor substrate (preferably a semiconductor substrate; most preferably a semiconductor wafer); providing a chemical mechanical polishing pad of the present invention; installing onto the platen the chemical mechanical polishing pad; optionally providing a polishing medium at an interface between the polishing surface and the substrate; creating dynamic contact between the polishing surface and the substrate, wherein at least some material is removed from the substrate; and, determining a polishing endpoint by transmitting light from the light source through a broad spectrum, endpoint detection window block and analyzing the light reflected off the surface of the substrate back through the broad spectrum, endpoint detection window block incident upon the photosensor. Preferably, the polishing endpoint is determined based on an analysis of multiple individual wavelengths of light reflected off the surface of the substrate and transmitted through the broad spectrum, endpoint detection window block, wherein the individual wavelengths of light have a wavelength of 200 to 1,000 nm. More preferably, the polishing endpoint is determined based on an analysis of multiple wavelengths of light reflected off the surface of the substrate and transmitted through the broad spectrum, endpoint detection window block, wherein at least one of the individual wavelengths analyzed has a wavelength of 370 nm to 400 nm.

Some embodiments of the present invention will now be described in detail in the following Examples.

Comparative Example WBC

Preparation of Endpoint Detection Window Block

A polyurethane, condensation polymer endpoint detection window block was prepared as follows. A diethyl toluene diamine "DETDA" (Ethacure® 100 LC available from Albemarle) was combined with an isocyanate terminated prepolymer polyol (LW570 prepolymer polyol available from Chemtura) at stoichiometric ratio of —$NH_2$ to —NCO of 105%. The resulting material was then introduced into a mold. The contents of the mold were then cured in an oven for eighteen (18) hours. The set point temperature for the oven was set at 93° C. for the first twenty (20) minutes; 104° C. for the following fifteen (15) hours and forty (40) minutes; and then dropped to 21° C. for the final two (2) hours. Window blocks having a diameter of 10.795 cm and an average thickness of 30 mils were then cut from the cured mold contents.

Example WB1

Preparation of Endpoint Detection Window Block

Circular test windows having a 10.795 cm diameter were cut from a 20 mil thick sheet of a polydicyclopentadiene cyclic olefin polymer (available from Zeon Corporation as Zeonor® 1420R).

Example WB2

Preparation of Endpoint Detection Window Block

Circular test windows having a 10.795 cm diameter were cut from a 20 mil thick sheet of a cyclic olefin copolymer prepared from norbornene and ethylene using a metallocene catalyst (available from Topas Advanced Polymers, Inc. as Topas® 6013).

Example T1

Window Block Spectrum Loss Analysis

The window block materials prepared according to Comparative Example WBC and Examples WB1-WB2 were then tested according to ASTM D1044-08 using a Verity SD1024D Spectrograph outfitted with a Verity FL2004 flash lamp and Spectraview 1 software version VI 4.40 and a Taber 5150 Abraser model abrasion tool set up with a Type H22 abrasive wheel, a 500 g weight, 60 rpm and 10 cycles. The transmission loss at various wavelengths measured for the window block materials are reported in TABLE 1. Also reported in Table 1 is the spectrum loss for each of the window block materials.

TABLE 1

| | Transmission Loss @ λ (in %) | | | | | | |
|---|---|---|---|---|---|---|---|
| Ex. | 250 nm | 275 nm | 300 nm | 325 nm | 400 nm | 800 nm | Spectrum Loss |
| WBC | −42.9 | −50.0 | −85.7 | −70.7 | −71.6 | −74.9 | 72.50 |
| WB1 | −17.0 | −2.0 | −22.1 | −24.7 | −26.5 | −31.3 | 28.83 |
| WB2 | −23.8 | −24.7 | −26.5 | −27.2 | −29.1 | −30.4 | 29.21 |

We claim:

1. A chemical mechanical polishing pad comprising:

a polishing layer having a polishing surface; and, a broad spectrum, endpoint detection window block having a thickness, $T_W$, along an axis perpendicular to a plane of the polishing surface;

wherein the broad spectrum, endpoint detection window block consists of a cyclic olefin addition polymer; wherein the broad spectrum, endpoint detection window block exhibits a uniform chemical composition across its thickness, $T_W$; wherein the broad spectrum, endpoint detection window block exhibits a spectrum loss ≤40%; and, wherein the polishing surface is adapted for polishing a substrate selected from a magnetic substrate, an optical substrate and a semiconductor substrate.

2. The chemical mechanical polishing pad of claim 1, wherein the broad spectrum, endpoint detection window block has an average thickness, $T_{W\text{-}avg}$, along an axis perpendicular to the plane of the polishing surface of 5 to 75 mils.

3. The chemical mechanical polishing pad of claim 2, wherein the cyclic olefin addition polymer is selected from a cyclic olefin addition polymer and a cyclic olefin addition copolymer.

4. The chemical mechanical polishing pad of claim 3, wherein the cyclic olefin addition polymer is produced from a polymerization of at least one alicyclic monomer; wherein the at least one alicyclic monomer is selected from the group consisting of alicyclic monomers having an endocyclic double bond and alicyclic monomers having an exocyclic double bond.

5. The chemical mechanical polishing pad of claim 4, wherein the alicyclic monomers having an endocyclic double bond are selected from the group consisting of norbornene; tricyclodecene; dicyclopentadiene; tetracyclododecene; hexacycloheptadecene; tricycloundecene; pentacyclohexadecene; ethylidene norbornene; vinyl norbornene; norbornadiene; alkylnorbornenes; cyclopentene; cyclopropene; cyclobutene; cyclohexene; cyclopentadiene; cyclohexadiene; cyclooctatriene; and, indene; and, wherein the alicyclic monomers having an exocyclic double bond are selected from the group consisting of vinyl cyclohexene, vinyl cyclohexane, vinyl cyclopentane and vinyl cyclopentene.

6. The chemical mechanical polishing pad of claim 3, wherein the cyclic olefin addition copolymer is produced from a copolymerization of at least one alicyclic monomer and at least one acyclic olefin monomer.

7. The chemical mechanical polishing pad of claim 6, wherein the at least one alicyclic monomer is selected from the group consisting of an alicyclic monomer having an endocyclic double bond and an alicyclic monomer having an exocyclic double bond;

wherein the alicyclic monomers having an endocyclic double bond are selected from the group consisting of norbornene; tricyclodecene; dicyclopentadiene; tetracyclododecene; hexacycloheptadecene; tricycloundecene; pentacyclohexadecene; ethylidene norbornene; vinyl norbornene; norbornadiene; alkylnorbornenes; cyclopentene; cyclopropene; cyclobutene; cyclohexene; cyclopentadiene; cyclohexadiene; cyclooctatriene; and, indene;

wherein the alicyclic monomers having an exocyclic double bond are selected from the group consisting of vinyl cyclohexene, vinyl cyclohexane, vinyl cyclopentane and vinyl cyclopentene; and, wherein the at least one acyclic olefin monomer is selected from the group consisting of ethylene; propylene; 1-butene; isobutene; 2-butene; 1-pentene; 1-hexene; 1-heptene; 1-octene; 1-nonene; 1-decene; 2-methyl-1-propene; 3-methyl-1-pentene; 4-methyl-1-pentene; 2-butene; butadiene; isoprene; 1,3-pentadiene; 1,4-pentadiene; 1,3-hexadiene; 1,4-hexadiene; 1,5-hexadiene; 1,5-heptadiene; 1,6-heptadiene; 1,6-octadiene; 1,7-octadiene; and, 1,9-decadiene.

8. The chemical mechanical polishing pad of claim 2, wherein the cyclic olefin addition polymer is represented by a formula selected from the group consisting of (I)

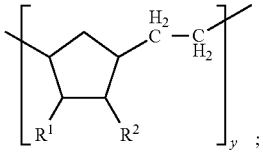

wherein y is 20 to 20,000; and, wherein $R^1$ and $R^2$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl;

(II)

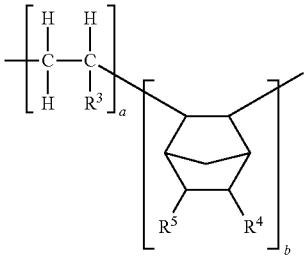

wherein the ratio of a:b is 0.5:99.5 to 30:70; wherein $R^3$ is selected from the group selected from a H and a $C_{1-10}$ alkyl group; and, wherein $R^4$ and $R^5$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl;

(III)

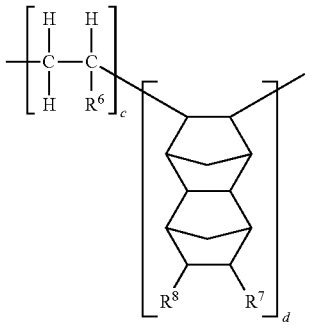

wherein the ratio of c:d in the cyclic olefin addition copolymer is 0.5:99.5 to 50:50; wherein $R^6$ is selected from the group selected from H and a $C_{1-10}$ alkyl group; and, wherein $R^7$ and $R^8$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl; and, (IV)

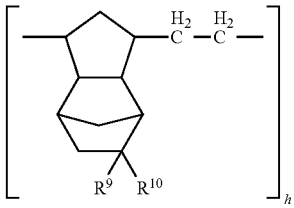

wherein h is 20 to 20,000; and, wherein $R^9$ and $R^{10}$ are each independently selected from the group consisting of a H, a hydroxyl group, a $C_{1-10}$ alkyl group, a $C_{1-10}$ hydroxyalkyl group, a $C_{1-10}$ alkoxyl group, a $C_{1-10}$ alkoxyalkyl group, a $C_{1-10}$ carboxyalkyl group, a $C_{1-10}$ alkoxycarbonyl and a $C_{1-10}$ alkylcarbonyl.

9. The chemical mechanical polishing pad of claim 2, wherein the broad spectrum, endpoint detection window block is a plug in place window.

* * * * *